US007760900B2

(12) United States Patent
Kemmerer

(10) Patent No.: US 7,760,900 B2
(45) Date of Patent: Jul. 20, 2010

(54) SPEAKER GRILLE ATTACHMENT SYSTEM

(75) Inventor: Jason Kemmerer, Torrance, CA (US)

(73) Assignee: Alpine Electronics, Inc., Tokyo (JP)

( * ) Notice: Subject to any disclaimer, the term of this patent is extended or adjusted under 35 U.S.C. 154(b) by 1191 days.

(21) Appl. No.: 11/343,319

(22) Filed: Jan. 31, 2006

(65) Prior Publication Data

US 2007/0177754 A1 Aug. 2, 2007

(51) Int. Cl.
*H04R 1/02* (2006.01)

(52) U.S. Cl. ..... 381/391; 381/386

(58) Field of Classification Search ..... 381/391; 181/150

See application file for complete search history.

(56) References Cited

U.S. PATENT DOCUMENTS 4,032,725 A * 6/1977 McGee ..... 381/395
4,277,653 A * 7/1981 Pawelzick ..... 381/395
4,550,230 A 10/1985 Johnson
4,993,511 A * 2/1991 Hiraki et al. ..... 181/150
5,331,119 A * 7/1994 Leger et al. ..... 181/150
5,731,551 A 3/1998 Petrucci

FOREIGN PATENT DOCUMENTS

JP 10-276488 10/1998

* cited by examiner

*Primary Examiner*—Curtis Kuntz
*Assistant Examiner*—Matthew Eason
(74) *Attorney, Agent, or Firm*—Muramatsu & Associates

(57) ABSTRACT

A speaker grille attachment system for a loudspeaker securely and easily attaches a speaker grille to the speaker as well as attains an improved aesthetic effect by hiding components used for the attachment. The attachment system includes a plurality of fastening members, a plurality of clamp hole pieces each having a hole for inserting the fastening member therethrough, a plurality of openings formed on an outer rim of the speaker grille, a speaker gasket having a plurality of openings each receiving the clamp hole piece and the fastening member, a speaker frame or cabinet having a plurality of fastening means for attaching the speaker grille, and a cover member for covering an area of the outer rim of the speaker grille thereby making the components for the attachment invisible.

8 Claims, 12 Drawing Sheets

SPEAKER GRILLE ATTACHMENT SYSTEM

FIELD OF THE INVENTION

This invention relates generally to a speaker grille attachment system for a loudspeaker, and more particularly, to a speaker grille attachment system for a loudspeaker that can securely attach the speaker grille on the speaker and attain aesthetic appearance by hiding components used for the attachment.

BACKGROUND OF THE INVENTION

Loudspeakers, or speakers, are well known in the art and are commonly used in a variety of applications, such as in home theater audio systems, car audio systems, indoor and outdoor concert halls, and the like. A loudspeaker typically includes an acoustic transducer comprised of an electro-mechanical device which converts an electrical signal into acoustical energies in the form of sound waves and an enclosure for directing the sound waves produced upon application of the electrical signal.

Usually, a speaker grille is attached to the top of a loudspeaker as a protection shield for the speaker so that foreign objects would not drop or inadvertently damage the speaker cone. The speaker grille also serves to attain aesthetic appearance of the loudspeaker. In some cases, speaker grilles are installed on cabinets of the speaker. In other cases, the speaker grilles are installed to the frame of the speaker itself at the top end thereof through a speaker gasket.

The speaker grille is generally made of meshed metallic plate that prevents foreign objects from entering the speaker while allowing air to pass through. An example of such a speaker grille is shown in a plan view of FIG. 11. In this example, a plurality of screw holes 311 are provided on the rim of a speaker grille 313. The screw holes 311 are sized to be suitable for the intended screws be inserted for fastening the speaker grille 313. The screws fasten the speaker grille 313 to a speaker frame through a gasket. In the alternative, the screws may fasten the speaker grille 313 to a speaker cabinet through a gasket when the speaker cabinet is incorporated.

The arrangement of FIG. 11 has a problem in that an aesthetic effect is not attractive because of the visible screws. Moreover, because the screw heads that secure the speaker grille 313 to the speaker are relatively small, the fastening would not be strong enough. In a speaker system installed to a vehicle, the screw holes provided on the speaker grille may wear off due to shocks, vibrations or other stress, which further decreases the fastening strength of the speaker grille.

Thus, a new speaker grille attachment system is desired that can provide aesthetic appearance and also can securely attach the speaker grille to the speaker.

SUMMARY OF THE INVENTION

It is, therefore, an object of the present invention to provide a speaker grille attachment system which is capable of securely attaching the speaker grille to the speaker as well as attaining a high aesthetic effect.

In the present invention, a speaker grille attachment system for mounting a speaker grille on a speaker includes a plurality of fastening members, a plurality of clamp hole pieces each having a hole for inserting the fastening member therethrough, a plurality of openings formed on an outer rim of the speaker grille for inserting the clamp hole pieces and the fastening members, a speaker gasket having a plurality of openings each receiving a lower part of the clamp hole piece and the fastening member, a speaker frame having a plurality of fastening means for attaching the speaker grille in combination of the clamp hole piece and the fastening member, and a cover member for covering an area of the outer rim of the speaker grille, thereby making the clamp hole pieces, the fastening members and the openings on the speaker grille invisible.

The cover member has a hook portion which fits with a notch portion formed on the speaker gasket when the cover member is pressed to the speaker gasket, thereby attaching the cover member to the speaker gasket. The cover member has a ring shape and is made of elastic material. Preferably, the cover member has a positioning tab that contacts with the corresponding opening on the speaker grille to facilitate accurate positioning of the cover member with respect to the speaker grille.

The clamp hole piece has a cylindrical portion through which the hole for the fastening member is created. The cylindrical portion extends downwardly to engage with the opening formed on the speaker gasket. The clamp hole piece has a pressing surface for contacting and pressing the outer rim of the speaker grille when the speaker grille is attached to the speaker frame. A bottom surface of the clamp hole piece establishes the pressing surface.

Preferably, the clamp hole piece is indented at a top of the cylindrical portion to establish a space that receives a head of the fastening member so that the head of the fastening member will not project from a top surface of the clamp hole piece. Preferably, an inner wall of the clamp hole piece is curved to match a curve of the speaker grille and an outer wall of the clamp hole piece is curved to match an arc of the outer rim of the speaker grille.

According to the present invention, the speaker grille attachment system can securely attach the speaker grille to the speaker. Moreover, the speaker grille attachment system can improve the aesthetic effect or appearance of the speaker grille by concealing the components used for mounting the speaker grille.

Still other objects and advantages of the present invention will become readily apparent to those skilled in this art from the following detailed description, wherein only the preferred embodiment of the invention is shown and described simply by way of illustration of the best mode contemplated of carrying out the invention. The drawing and descriptions will be regarded as illustrative in nature and not as restrictive.

BRIEF DESCRIPTION OF THE INVENTION

FIG. 5A is a plan view thereof and FIG. 5B is a perspective view thereof.

FIG. 7A is a plan view of the cover member, FIG. 7B is a bottom view of the cover member, FIG. 7C is a perspective bottom view showing a part of the cover member.

FIG. 8A is a bottom view thereof, and FIGS. 8B and 8C are cross sectional views thereof showing the structural relationship among the speaker grille, clamp hole piece, screw, and cover member.

Figure 9A:
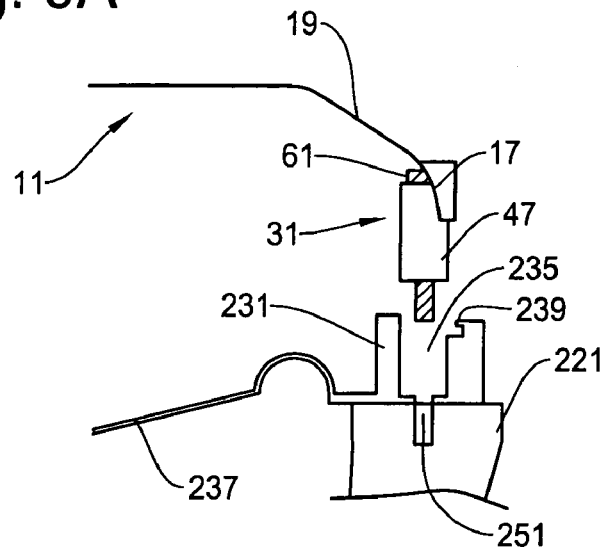
Figure 9B:
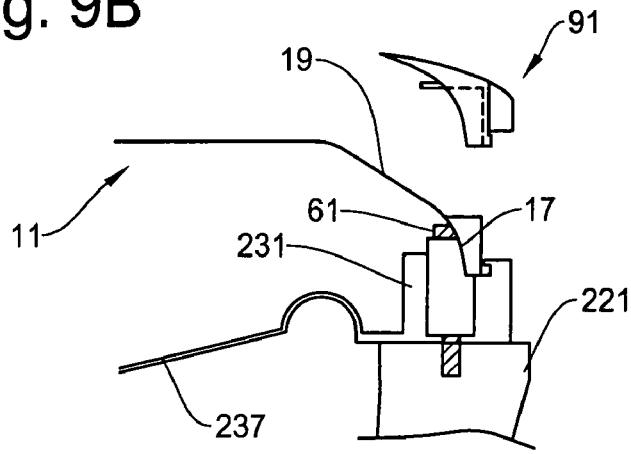
Figure 9C:
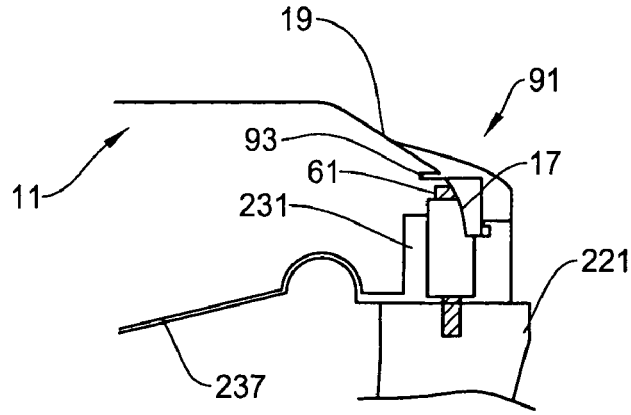

FIGS. 9A-9C are cross sectional views showing the process for attaching the speaker grille to the speaker frame, where the speaker grill with the clamp hole piece is positioned over the speaker gasket and the speaker frame in FIG. 9A, the speaker grille is attached to the speaker frame and the cover member is positioned over the speaker grille in FIG. 9B, and the cover member is attached to the rim of the speaker grille in FIG. 9C.

Figure 10:
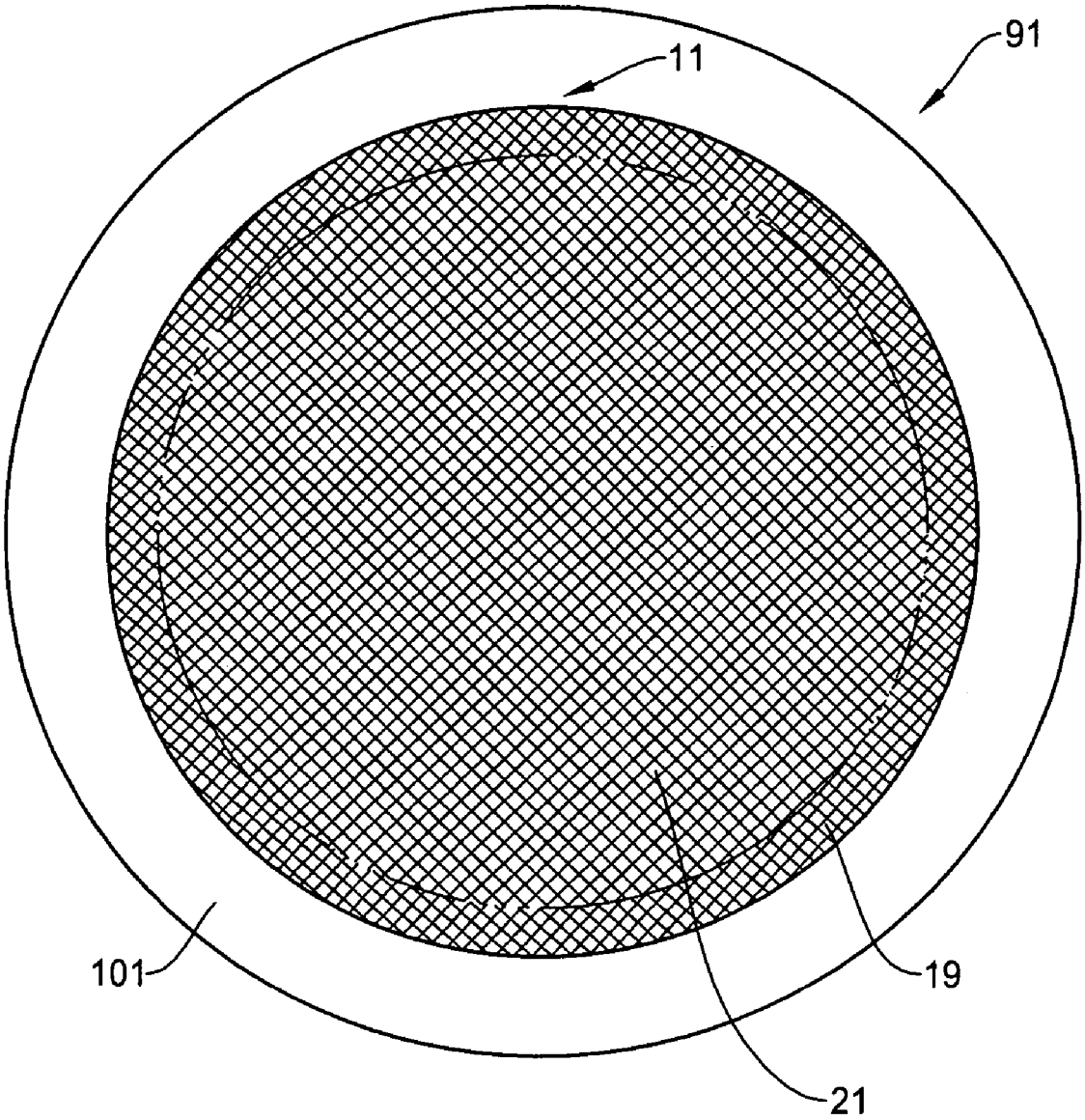

FIG. 10 is an overall plan view of the speaker grille using the clamp hole pieces and the cover member in accordance with the speaker grille attachment system of the present invention.

Figure 11:
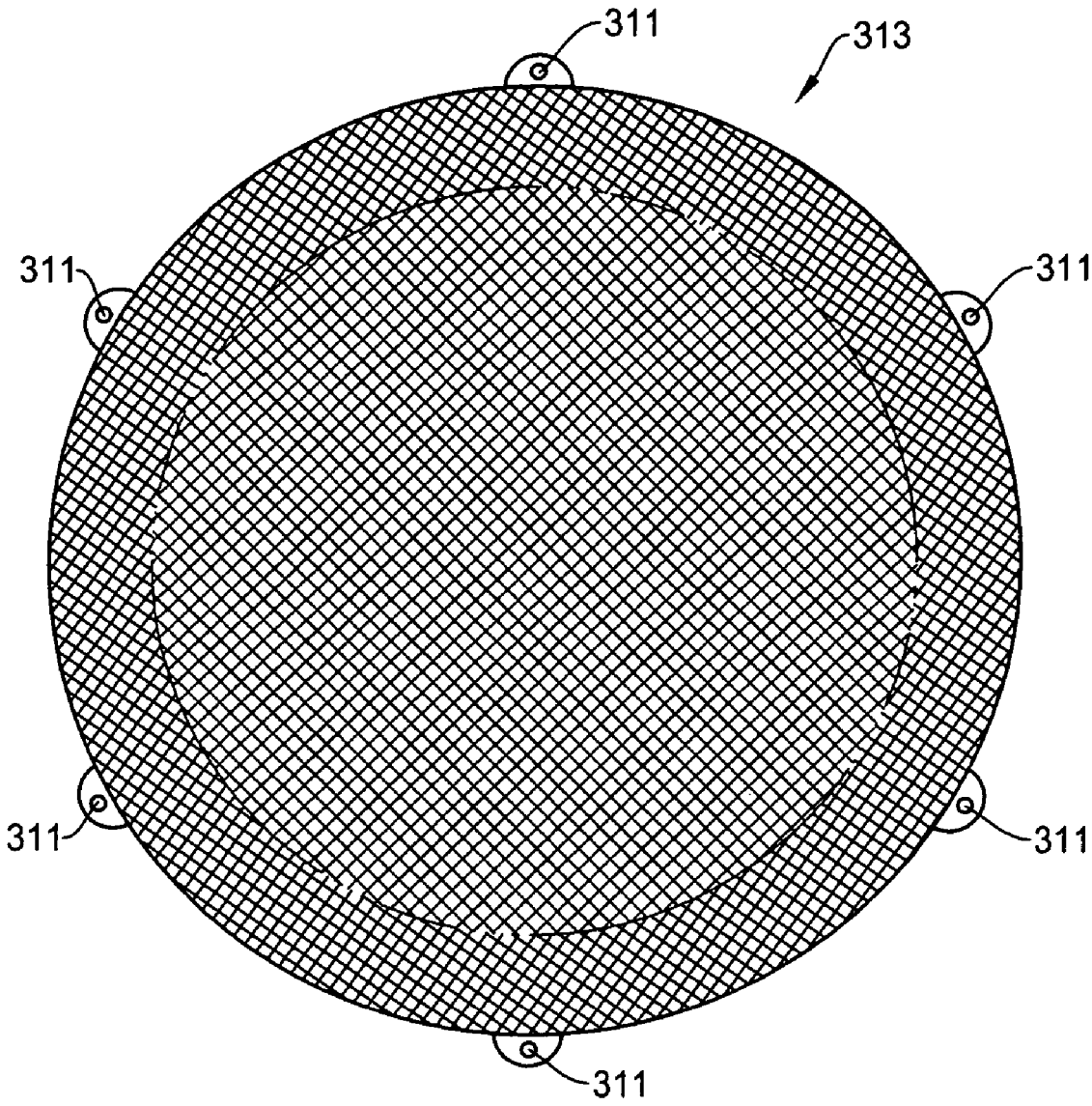
Fig. 11 (Prior Art)

FIG. 11 is a plan view showing an example of speaker grille in the conventional technology having screw holes exposed on the rim.

DETAILED DESCRIPTION OF THE INVENTION

An embodiment of the present invention is described with reference to the accompanied drawings. The speaker grille attachment system in accordance with the present invention utilizes a plurality of clamp hole pieces, a cover (concealment) member, and a speaker grille. The clamp hole piece has a hole for inserting a fastening member therethrough and a pressing surface for contacting with a surface of the speaker grille for attaching the speaker grille to a speaker frame and a speaker gasket.

The speaker grille is typically made of meshed metal plate and has screw openings at its outer rim for the screws projected from the holes of the clamp hole pieces. The clamp hole pieces are typically made of plastic to clamp the outer rim of the speaker grill. The cover member is typically made of synthetic rubber or other elastic material and has a ring like shape which is provided with hook portions to fit to the speaker gasket. The cover member covers the outer rim of the speaker grille to hide the screws, screw holes of the speaker grille and the clamp hole pieces, etc.

Figure 1:
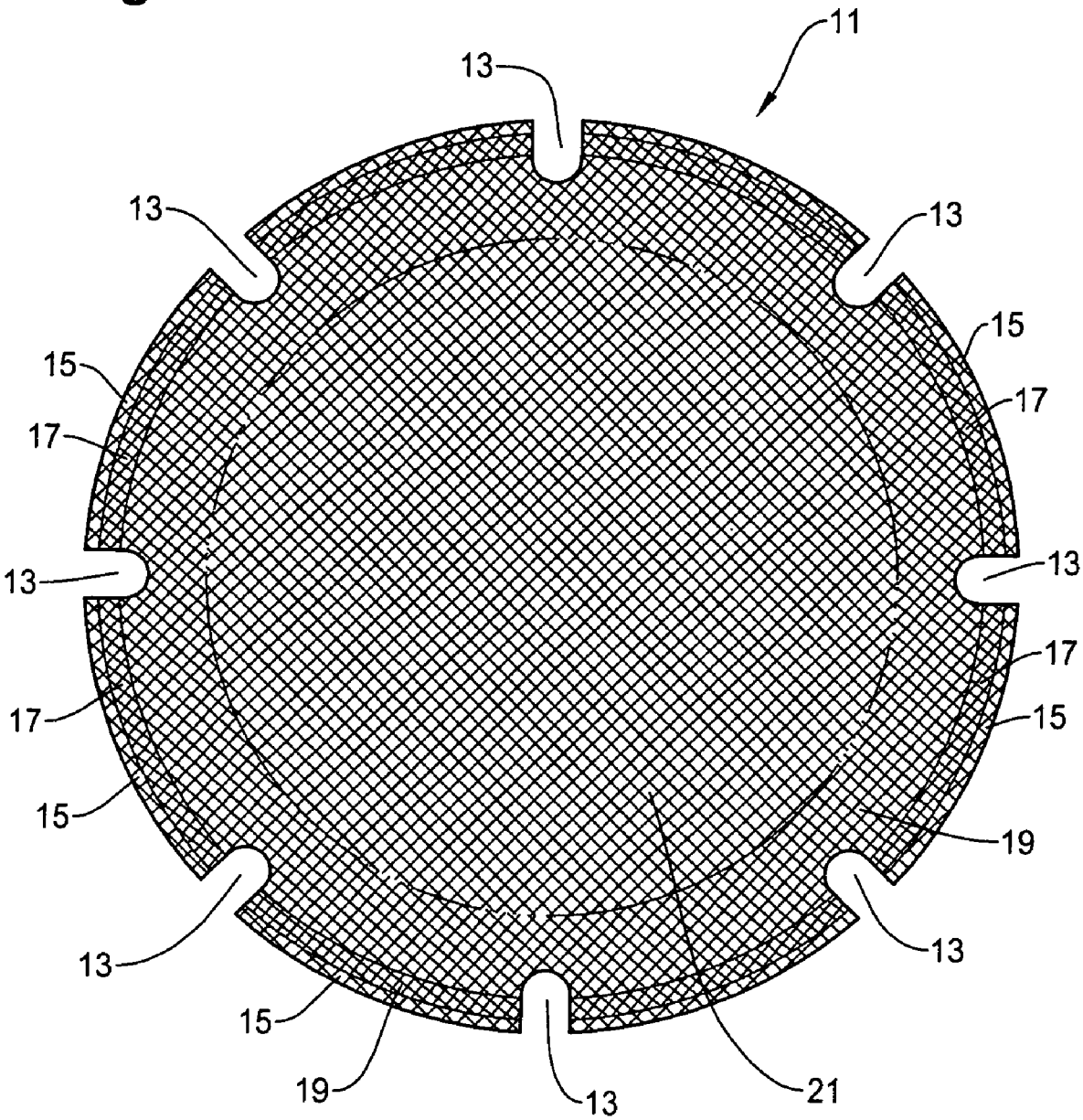
FIG. 1 is a plan view showing an example of structure of the speaker grille in the preferred embodiment of the present invention.

FIG. 1 is a top view showing a speaker grille 11 in a preferred embodiment of the present invention. As noted above, the speaker grille typically has a meshed metallic structure. Due to the pores created by the mesh, the sound waves from the speaker cone can pass through the grille while foreign objects are prevented from entering the speaker system. In this embodiment, a plurality of openings (cut-outs) 13 are formed at the rim of the speaker grille 11 in a manner shown in FIG. 1.

Figure 6A:
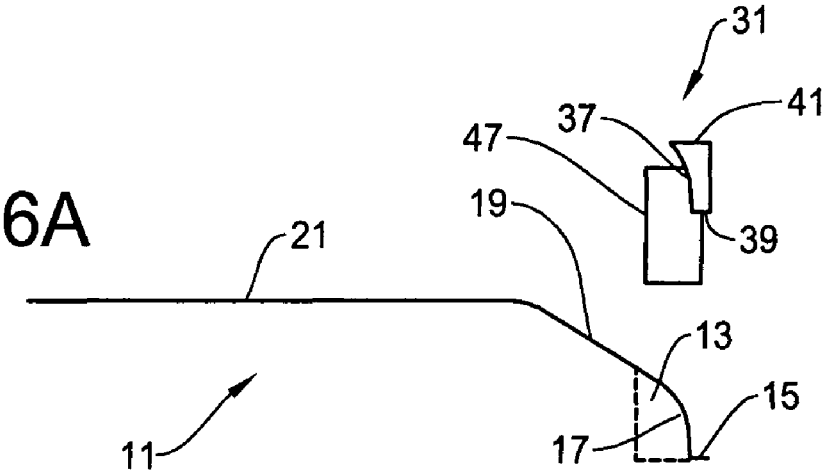
FIGS. 6A to 6C are schematic cross sectional views of the right side of the speaker grille and the clamp hole piece in the speaker grille attachment system of the present invention for explaining the procedure of assembling the clamp hole piece and screws with the speaker grille.

The number and position of the openings 13 correspond to screw holes formed on a speaker gasket 231 and a speaker frame 221 (FIGS. 9A-9B). The speaker grill 11 has press surfaces 15 at the outer rim which is clamped by the clamp hole piece when the speaker grille is attached to the speaker frame of cabinet. The speaker grill 11 also comprises angled surfaces 17 and 19 and the grille surface 21. As seen from FIG. 1, each opening (cut-outs) 13 extends from the press surface 15 to the angled surfaces 17 and 19. FIG. 6A schematically shows a cross sectional view of the right side of the speaker grille 11. As shown in FIG. 6A, the press surface 15 is flat to contact with the upper surface of the speaker gasket 231. The angled surfaces 17 and 19 achieve aesthetic appearance as well as create the raised grille surface 21 of the substantially flat surface.

Figure 2A:
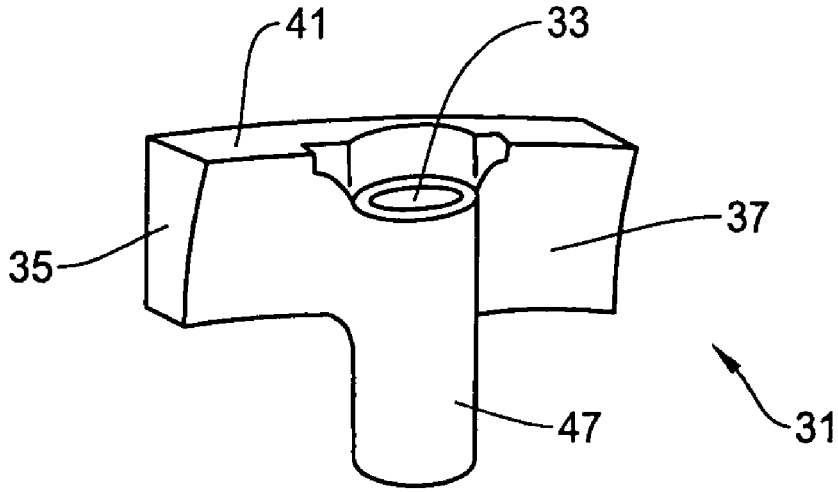
FIGS. 2A and 2B are perspective views showing an example of structure of a clamp hole piece incorporated in the speaker grille attachment system under the present invention.
Figure 2B:
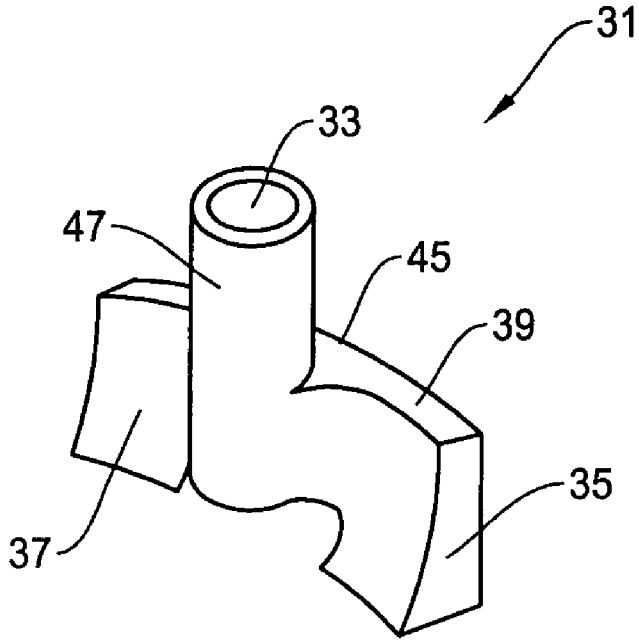
Figure 3A:
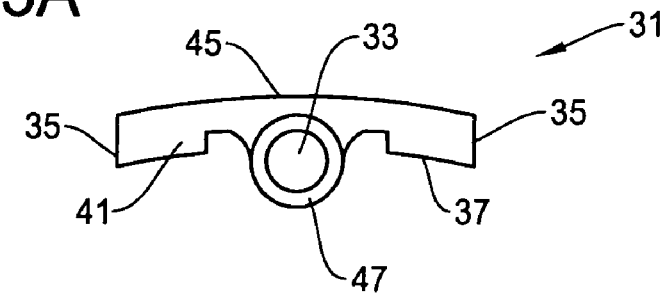
FIG. 3A is a plan view of the clamp hole piece.
Figure 3B:
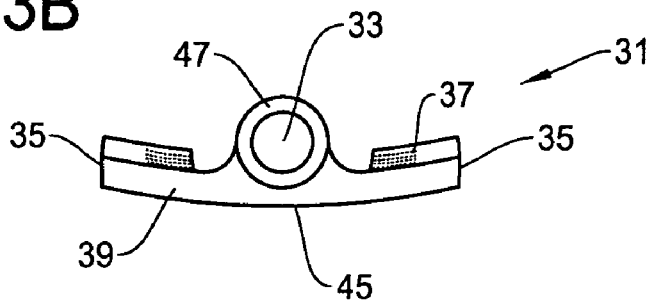
FIG. 3B is a bottom view of the clamp hole piece in accordance with the present invention.
Figure 4A:
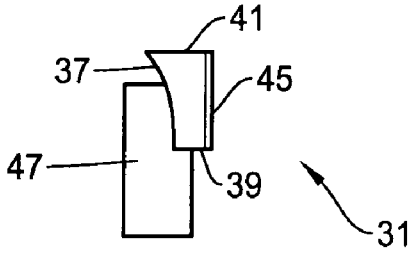
FIG. 4A is a right side view of the clamp hole piece.
Figure 4B:
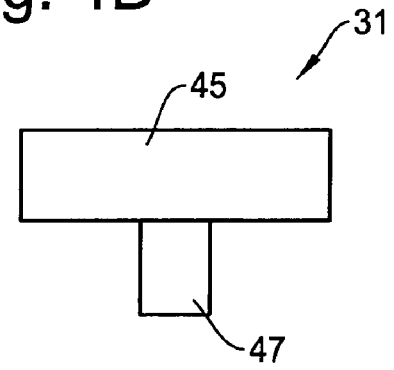
FIG. 4B is a rear view of the clamp hole piece.
Figure 4C:
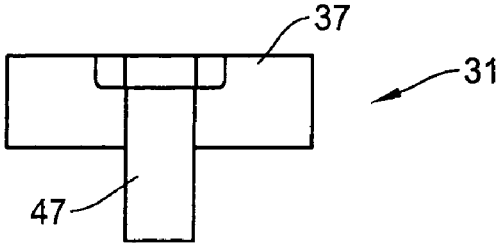
FIG. 4C is a front of the clamp hole piece.

FIGS. 2A-2B, FIGS. 3A-3B, and FIGS. 4A-4C show the clamp hole piece 31 incorporated in the grille attachment system of the present invention. FIG. 2A is a perspective view of the clamp hole piece 31, and FIG. 2B is a perspective view of the claim hole piece 31 when it is placed in an upside-down manner. FIG. 3A is a top view of the clamp hole piece, and FIG. 3B is a bottom view of the claim hole piece 31. FIG. 4A is a right side view of the clamp hole piece 31, FIG. 4B is a rear view of the clamp hole piece 31, and FIG. 4C is a front view of the clamp hole piece 31.

Referring to perspective views of FIGS. 2A and 2B, the overall structure of the clamp hole piece 31 in accordance with the present invention is described. FIG. 2B shows the clamp hole piece 31 that is viewed upside-down from the view shown in FIG. 2A. As shown, the clamp hole piece 31 comprises a screw hole 33 extended in a cylindrical portion 47, a pressing surface (portion) 39, side portions 35, a front surface (inner wall) 37, a top surface 41 and a back surface (outer wall) 45. The back surface 45 is best shown in FIGS. 3A-3B and FIG. 4B. The side portions 35, the back surface 45 and the top surface 41 comprise an upper portion of the clamp hole piece 31.

The screw hole 33 has an opening that is designed to insert a screw therethrough. The screw inserted in the screw hole 33 can project from the bottom end of the screw hole 33 to engage with the speaker frame or cabinet through the speaker gasket. The front surface 37 is curved to match with the angled surface 17 of the speaker grille 11 as will be explained later. As shown in FIG. 2A, a space is provided between the top opening of the screw hole 33 and the top surface 41. The space is to establish a clearance for a head of a screw inserted in the screw hole 33 will be below the top surface 41. The pressing surface 39 has a surface area that contacts with the press surface 15 on the outer rim of the speaker grille 11 when the clamp hole piece 31 is mounted on the speaker grille 11.

As shown in the plan view of FIG. 3A and the bottom view of FIG. 3B, the front surface 37 and the back surface 45 of the clamp hole piece 31 are curved to generally match with the arc of the speaker grille 11. As noted above, the front surface 37 is also curved to match with the angled surface 17 of the speaker grille 11. The screw hole 33 is a through hole so that a screw inserted from the top of the cylindrical portion 47 will be projected from the bottom of the cylindrical portion 47.

As seen from the right side view of FIG. 4A, the surface area of the top surface 41 is larger than that of the pressing surface 39 due to the curvature of the curved surface 37. As noted above, the curved surface 37 has an appropriate curve to match with the surface of the angled portion 17 of the speaker grille 11. As shown in the rear view of FIG. 4B, the cylindrical portion 47 is downwardly extended from the body of the clamp hole piece 31. As seen from the front view of FIG. 4C, the space (clearance) noted above for the screw head is created at the top of the cylindrical portion 47.

Figure 5A:
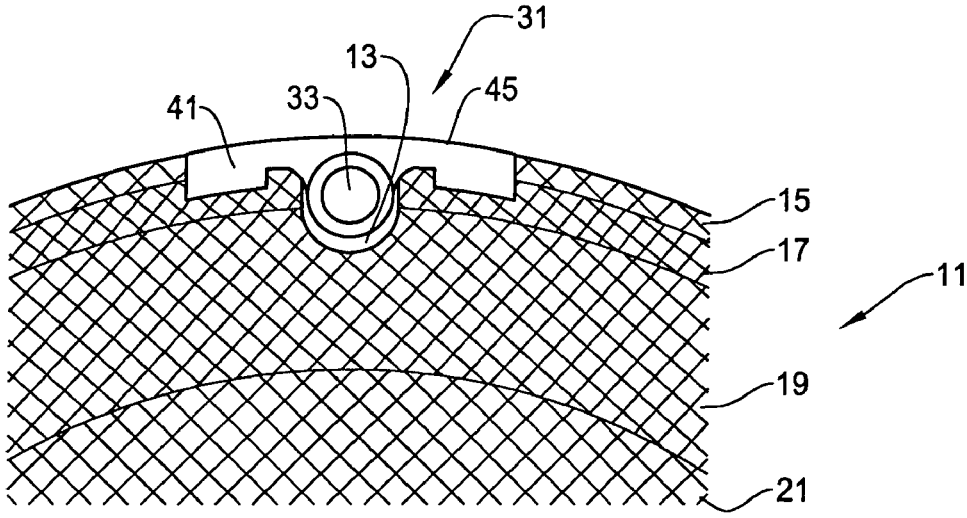
FIGS. 5A and 5B show enlarged views showing the clamp hole piece and a part of the speaker grille in the speaker grille attachment system of the present invention where
Figure 5B:
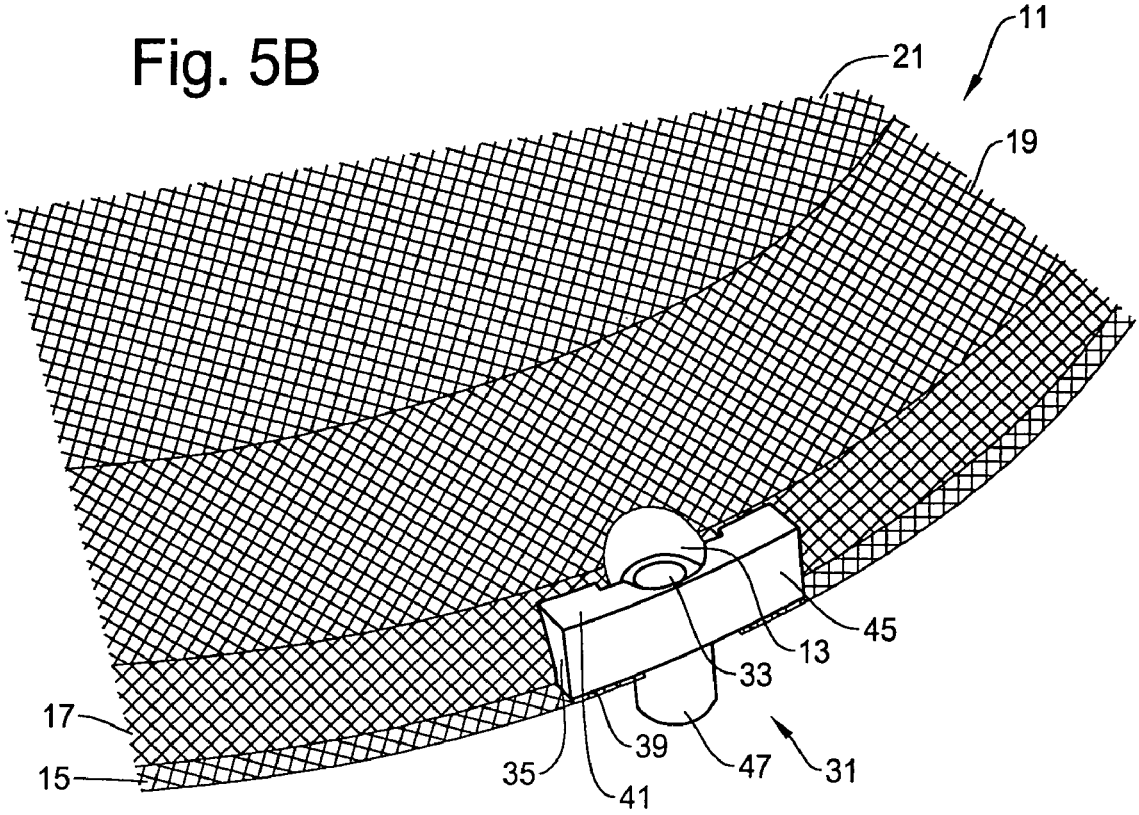
Figure 6B:
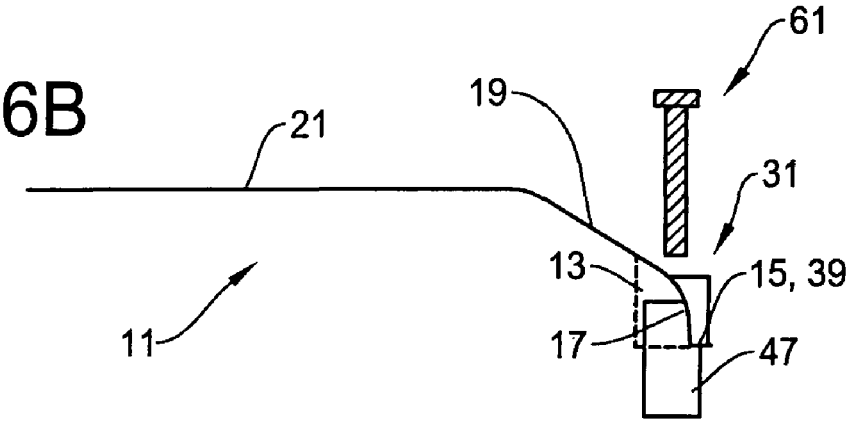
Figure 6C:
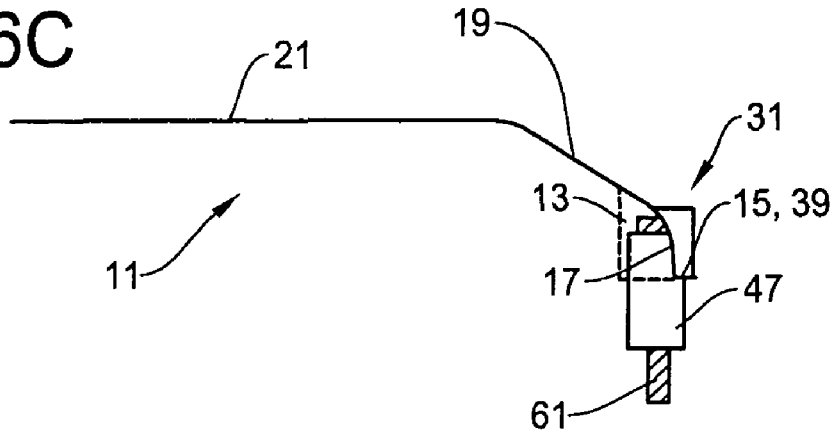

The relationship between the speaker grille 11 and the clamp hole piece 31 is described in detail with reference to FIGS. 5A, 5B and FIGS. 6A-6C. FIG. 5A is an enlarged top view showing the speaker grille 11 and the clamp hole piece 31. FIG. 5B is a perspective view showing the speaker grille 11 and the clamp hole piece 31. FIGS. 6A-6C are schematic cross sectional views of the right side of the speaker grille and the clamp hole piece. FIGS. 6A-6C also show the process for assembling the clamp hole piece 31 with a screw on the speaker grille 11.

The top surface 41 and the screw hole 33 of the clamp hole piece 31 are shown in FIG. 5A. Although the pressing surface 39 is not visible in FIG. 5A, as seen from the perspective view of FIG. 5B and the cross sectional views of FIGS. 6B and 6C, the pressing surface 39 contacts the press surface 15 of the speaker grille 11. The opening 13 of the speaker grille 11 is large enough to receive the cylindrical portion 47 with the screw hole 33. The screw hole 33 receives a screw (FIGS. 6B and 6C) to securely fix the speaker grille 11 to the speaker frame or speaker cabinet. When the screw is inserted in the screw hole 33, due to the clearance (space) as shown in FIG. 4C, the head of the screw will fit in the clearance.

In FIG. 5B, the cylindrical portion 47 penetrates the opening 13 of the speaker grille 11 so that the cylindrical portion 47 will be fitted with the opening of the speaker gasket (FIGS. 9A-9C). The pressing surface 39 of the clamp hole piece 31 contacts and presses the press surface 15 of the speaker grille 11 when the screw is fastened to the speaker frame of cabinet. The curved surface 37 contacts the angled portion 17 of the speaker grille 11. The back surface 45 of the clamp hole piece 31 are curved to generally match with the arc of the speaker grille 11 as shown in FIGS. 5A and 5B.

The structure and process for mounting the clamp hole piece 31 and a screw 61 on the speaker grille 11 is schematically shown in the cross sectional views of FIGS. 6A-6C. Only the right side of the speaker grille 11 and the area where the opening 13 is located are illustrated in FIGS. 6A-6C. As shown, the speaker grille 11 comprises the press surface 15 at the outer rim, the angled surfaces 17 and 19, and the grille surface 21. In FIG. 6A, the clamp hole piece 31 is positioned over the opening 13 of the speaker grille 11.

In FIG. 6B, the cylindrical portion 47 of the clamp hole piece 31 having the screw hole 33 is inserted in the opening 13 of the speaker grille 11. The pressing surface 39 of the clamp hole piece 31 contacts the pressing surface 15 of the speaker grille 11. The front surface 37 of the clamp hole piece 31 is curved to fit the curvature and angle of the angled surface 17. A screw 61 is positioned over the clamp hole piece 31.

In FIG. 6C, the screw 61 is inserted in the screw hole 33 that penetrate through the cylindrical portion 47 of the clamp hole piece 31. The lower portion of the screw 61 is projected from the bottom end of the cylindrical portion 47 to engage with the speaker frame or speaker cabinet (FIGS. 9B and 9C). The pressing surface 39 of the clamp hole piece 31 contacts the press surface 15 of the speaker grille 11.

Figure 7A:
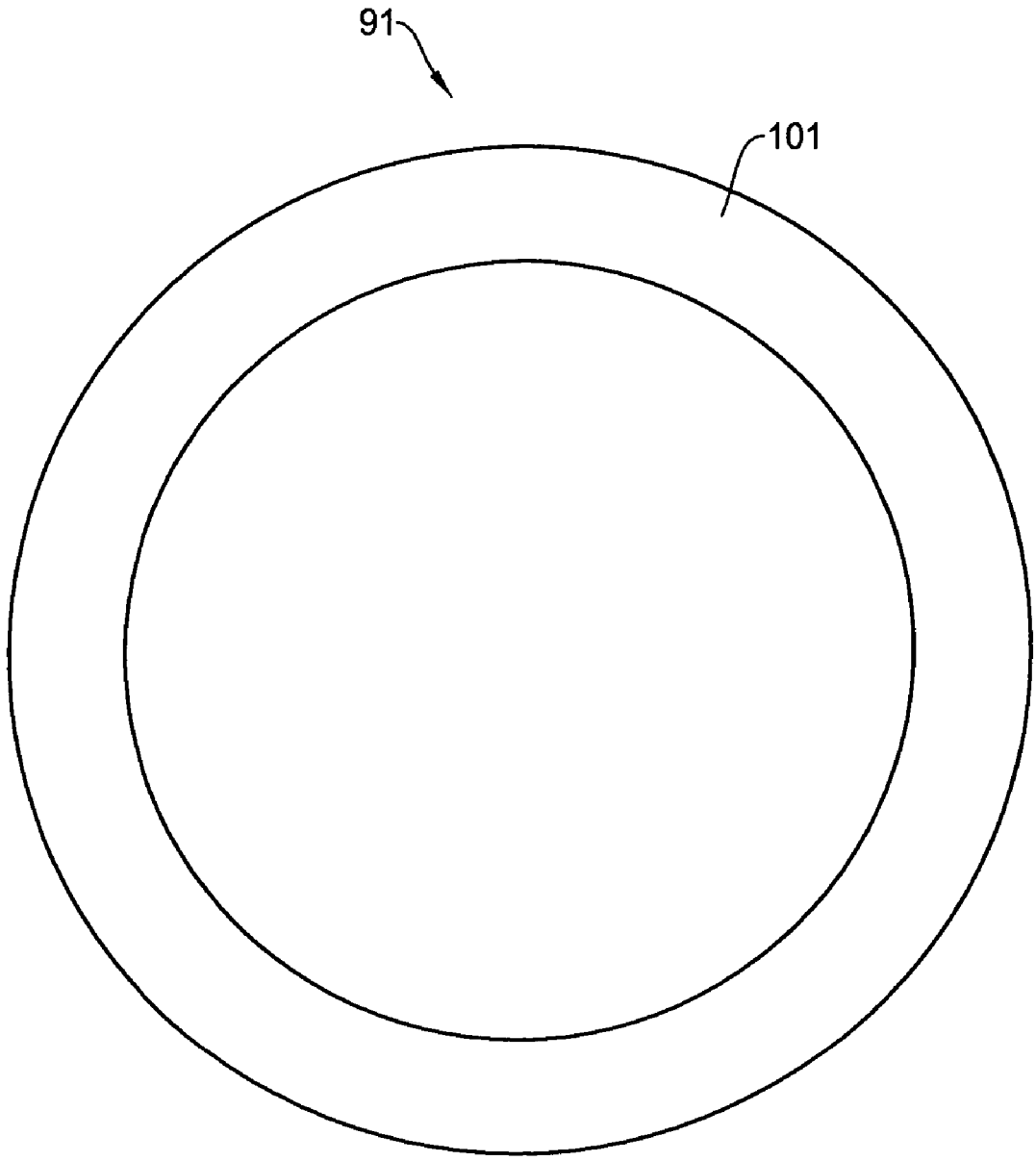
FIGS. 7A-7C show a cover member in the preferred embodiment of the present invention, where
Figure 7B:
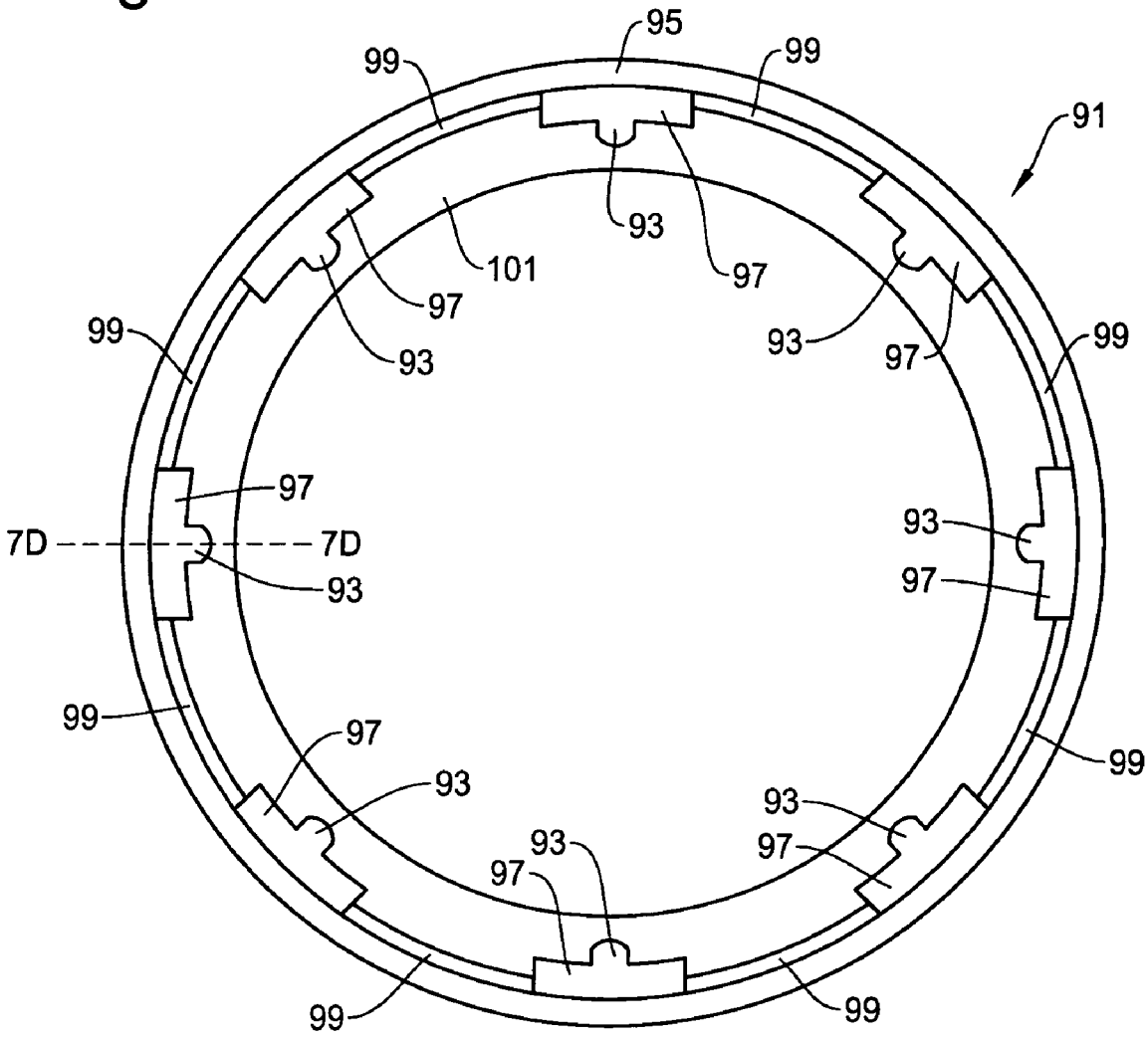
Figure 7C:
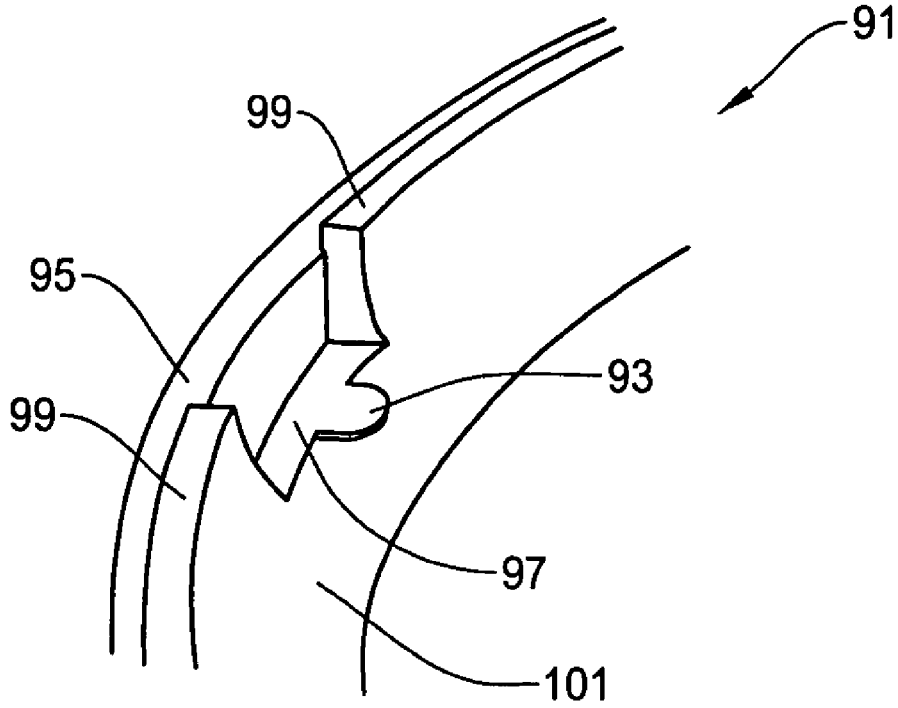
Figure 7D:
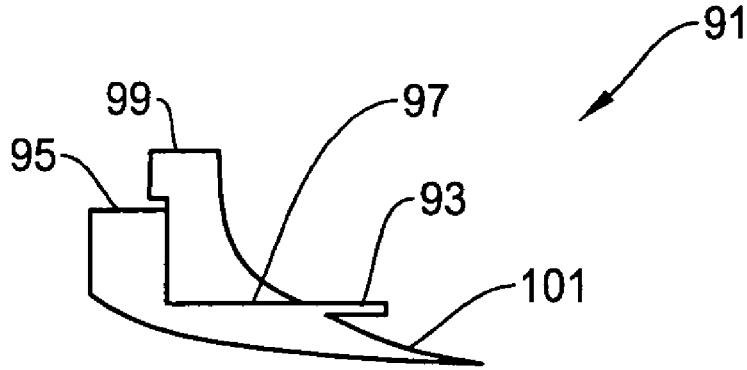
FIG. 7D is a cross sectional bottom view of the cover member taken along the 7D-7D line of FIG. 7B.

Reference is now made to FIGS. 7A-7D showing a structure of a cover member 91 incorporated in the speaker grille attachment system. FIG. 7A is a plan view of the cover member 91 and FIG. 7B is a bottom view of the cover member 91. FIG. 7C is a perspective bottom view showing a part of the cover member 91. FIG. 7D is a cross sectional bottom view of the cover member 91 taken along the 7D-7D line of FIG. 7B.

In the preferred embodiment, the cover member 91 has a generally ring like shape and is made of elastic material such as synthetic rubber. The cover member 91 is used to cover the rim of the speaker grille 11 after the speaker grille is attached to the speaker frame or cabinet though the clamp hole piece 31. The cover member 91 can effectively cover the outer rim area of the speaker grille to make the openings 13, screws 61, the clamp hole pieces 31, etc. invisible from the outside.

As shown in the plan view of FIG. 7A, an outer surface of the cover member 91 is made of a cover portion 101 which is slightly outwardly curved. The outer surface of cover portion 101 has a simple ring shape. As shown in the bottom view of FIG. 7B, the cover member 91 comprises a rim portion 95, a plurality of receptacle portions 97, positioning tabs 93, a hook portion 99, and the cover portion 101 (FIG. 7A).

The positioning tabs 93 work as marks to position the cover member 91 to the speaker grille 11. Specifically, the part comprising the positioning tab 93 and the receptacle portion 97 is designed to positionally correspond to the opening 13 of the speaker grille 11. Thus, when attaching the cover member 91 on the speaker grille, the positioning tabs 93 are adjusted to the position of the openings 13 on the speaker grille 11, thereby facilitating the positioning of the cover member 91 relative to the speaker grille 11.

The receptacle portion 97 is a recess for receiving the upper part of the clamp hole piece 31. Thus, a shape shown in the bottom view of the receptacle portion 97 is generally the same as that of the top surface 41 of the clamp hole piece 31. The rim portion 95 will contact the upper surface of the speaker gasket when attached thereto (FIG. 9C). As shown in the cross sectional view of FIG. 7D, the hook portion 99 has a small hook, which is adapted to be press-fit into a groove provided on the speaker gasket.

The perspective bottom view of FIG. 7C shows a part of the cover member 91. As apparent from this perspective view, the receptacle portion 97 is an indentation for receiving the upper part of the clamp hole piece 31. Specifically, the receptacle portion 97 is constructed by the curved wall of the rim portion 95, and the side of the hook portion 99. The positional tab 93 is a small thin member that projects from the receptacle portion 97.

Figure 8A:
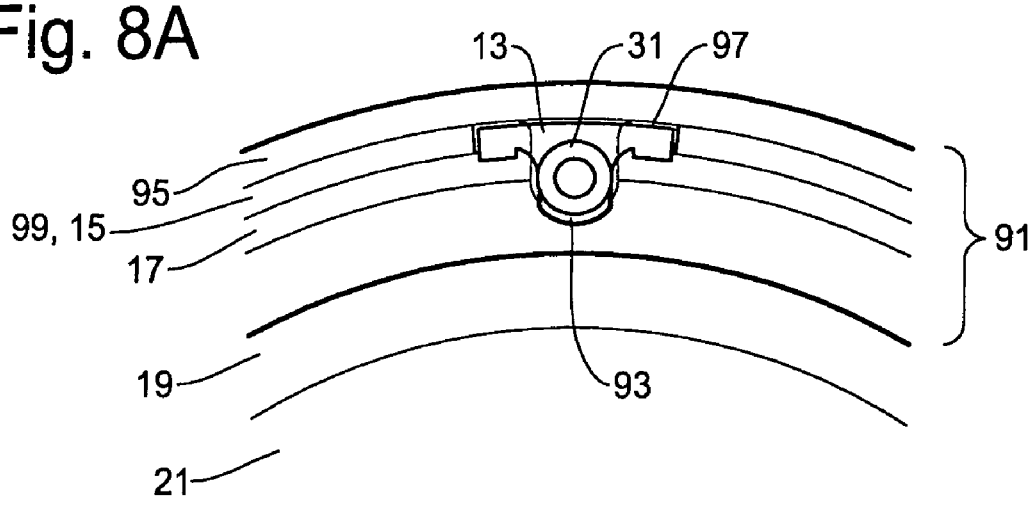
FIGS. 8A-8C show the structure of the speaker grille attachment system of the present invention, where
Figure 8B:
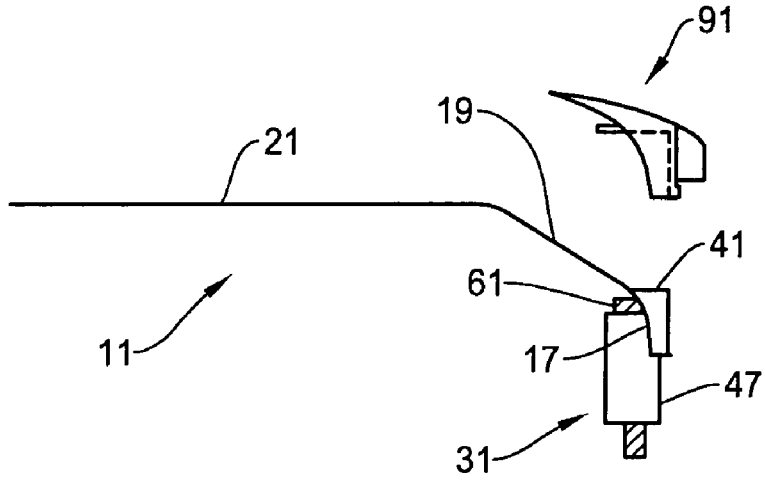
Figure 8C:
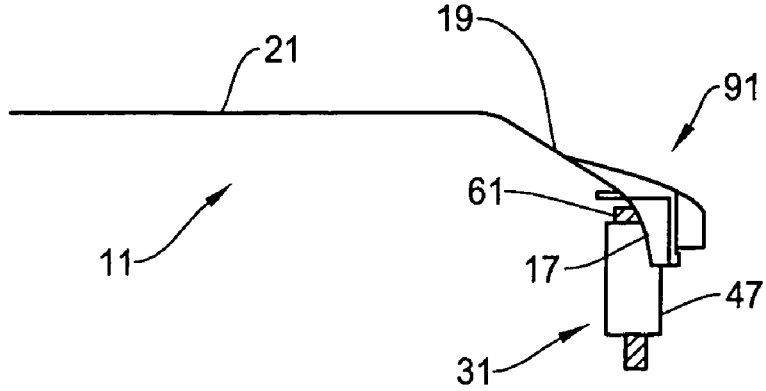

FIGS. 8A-8C show relationship among the cover member 91, the speaker grille 11, and the clamp hole piece 31 in the speaker grille attachment system of the present invention. Although only one set of such components is shown, plural sets of such components are used in an actual implementation of the present invention. FIG. 8A is a bottom view showing the cover member 91, the speaker grille 11, and the clamp hole piece 31 assembled together. FIG. 8B and FIG. 8C are cross sectional views showing the method of assembling the cover member 91, the clamp hole piece 31, and the speaker grille 11 with one another.

In FIG. 8A, the speaker grille 11 is illustrated in a transparent manner for showing the structural relationship among the components. The clamp hole piece 31 is fit in the space of the receptacle portion 97 of the cover member 91. The positioning knob 93 slightly engage with an inner edge of the opening 13 of the speaker grille 11, thereby achieving accurate positioning of the cover member 91 to the speaker grille 11. Although the positioning tab 93 is provided in this preferred embodiment to facilitate the positioning of the concealment part 91 with respect to the speaker grille, it may be omitted without affecting the advantages of the present invention.

In FIGS. 8B and 8C, the opening 13 formed on the speaker grille 11 for inserting the clamp hole piece 31 is omitted for simplicity of illustration. In the cross sectional view of FIG. 8B, the clamp hole piece 31 with the screw 61 is mounted on the speaker grille 11, which is identical to the situation of FIG. 6C. The cover member 91 is provided above the clamp hole piece 31 to cover the clamp hole piece 31 and the screw 61. In the cross sectional view of FIG. 8C, the cover member 91 is attached to cover the outer rim of the speaker grille 11 so that the clamp hole piece 31, the opening 13, and the screw 61 are invisible from the outside.

The cross sectional views of FIGS. 9A-9C show the process for attaching the speaker grille 11 to the speaker frame (or speaker cabinet) 221. Although only one set of clamp hole piece 31 and the screw 61 is shown, a plurality of sets of such components are used in an actual implementation of the present invention. The speaker grill 11 with the clamp hole pieces 31 and screws 61 is positioned over the speaker gasket 231 and the speaker frame 221 in FIG. 9A. The speaker grille 11 is attached to the speaker frame 221 and the cover member 91 is positioned over the speaker grille 11 in FIG. 9B. The cover member 91 is attached on the rim of the speaker grille 11 in FIG. 9C. In the example of FIGS. 9A-9C, a diaphragm 237 of the speaker that vibrates for producing sounds is attached to the speaker gasket 231.

As shown in FIG. 9A, the speaker frame 221 has a screw hole 251 that is suitably sized for fastening the screw 61 projected from the clamp hole piece 31. The speaker gasket 231 has holes 235 that are designed to receive the lower portion (ex. cylindrical portion 47) of the clamp hole piece 31. Typically, the speaker gasket 231 has a ring like shape and is made of elastic material such as synthetic rubber. The smaller hole at the bottom of the speaker gasket 231 allows the lower end of the screw 61 to reach the screw hole 251 on the speaker frame 221.

The speaker gasket 231 has a notch portion (groove) 239 that is designed to allow the hook portion 99 of the cover member 91 (FIGS. 7C and 7D) to snap-in. In FIG. 9B, when the speaker grille 11 with the clamp hole piece 31 is mounted on the speaker gasket 231, the screw 61 penetrates the speaker gasket 231 so that the screw 61 is fastened to the speaker frame 221. In FIG. 9C, the cover member 91 is mounted on the area of the outer rim of the speaker grille 11. As noted above, because the cover member 91 is made of elastic material such as rubber, the hook portion 99 can fit in the notch portion 239 formed on the speaker gasket 231, thereby securely attaching the cover member 91 to the speaker gasket 231.

The overall plan view of the speaker grille 11 using the speaker grille attachment system of the present invention is shown in FIG. 10. The cover member 91 covers the outer rim of the speaker grille 11 so that the clamp hole pieces 31, the screws 61 and other components are hidden under the cover member 91. Thus, other than the cover member 91, only the grille surface 21 and a part of the angled portion 19 of the speaker grille 11 are visible for improved aesthetics effects.

As has been described above, the speaker grille attachment system of the present invention can securely attach the speaker grille to the speaker. Moreover, the speaker grille attachment system can improve the aesthetic effect of the speaker grille by concealing the components used for mounting the speaker grille.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A speaker grille attachment system for mounting a speaker grille on a speaker, comprising:

a plurality of fastening members;

a plurality of clamp hole pieces each having a hole for inserting the fastening member therethrough;

a plurality of openings formed on an outer rim of the speaker grille for inserting the clamp hole pieces and the fastening members;

a speaker gasket having a plurality of openings each receiving a lower part of the clamp hole piece and the fastening member;

a speaker frame or cabinet having a plurality of fastening means for attaching the speaker grille in combination of the clamp hole piece and the fastening member; and a cover member which is generally ring shaped for covering an area of the outer rim of the speaker grille, thereby making the clamp hole pieces, the fastening members and the openings on the speaker grille invisible from outside;

wherein the clamp hole piece has a cylindrical portion through which a hole for the fastening member is created, and a bottom end of the cylindrical portion extends downwardly below a pressing surface of the clamp hole piece, where the pressing surface is shaped to correspond to a curvature of the outer rim of the speaker grille, and an upper portion of the clamp hole piece is fitted into a receptacle portion of the cover member.

2. A speaker grille attachment system as defined in claim 1, wherein the pressing surface makes contact with and presses the outer rim of the speaker grille when the speaker grille is attached to the speaker frame or frame.

3. A speaker grille attachment system as defined in claim 1, wherein the cover member has a hook portion which fits with a notch portion formed on the speaker gasket when the cover member is pressed to the speaker gasket, thereby attaching the cover member to the speaker gasket.

4. A speaker grille attachment system as defined in claim 1, wherein the cover member has a ring shape and is made of elastic material.

5. A speaker grille attachment system as defined in claim 1, wherein the cover member has a positioning tab that contacts with the corresponding opening on the speaker grille to facilitate accurate positioning of the cover member with respect to the speaker grille.

6. A speaker grille attachment system as defined in claim 2, wherein a bottom surface of the clamp hole piece establishes the pressing surface.

7. A speaker grille attachment system as defined in claim 1, wherein the clamp hole piece is indented at a top of the cylindrical portion to establish a space that receives a head of the fastening member so that the head of the fastening member will not project from a top surface of the clamp hole piece.

8. A speaker grille attachment system as defined in claim 1, wherein an inner wall of the clamp hole piece is curved to match a curve of the speaker grille and an outer wall of the clamp hole piece is curved to match an arc of the outer rim of the speaker grille.

* * * * *